US005278944A

United States Patent [19]

Sasaki et al.

[11] Patent Number: 5,278,944

[45] Date of Patent: Jan. 11, 1994

[54] SPEECH CODING CIRCUIT

[75] Inventors: Seishi Sasaki; Masayasu Miyake; Kenzo Urabe, all of Sendai, Japan

[73] Assignee: Kokusai Electric Co., Ltd., Tokyo, Japan

[21] Appl. No.: 914,848

[22] Filed: Jul. 15, 1992

[51] Int. Cl.[5] ..... G10L 5/00

[52] U.S. Cl. ..... 395/2.21; 395/2.2; 381/36; 381/43; 381/47

[58] Field of Search ..... 381/31, 36, 43, 47, 381/46; 395/2, 750

[56] References Cited

U.S. PATENT DOCUMENTS

| | | | |
|---|---|---|---|
| 4,720,861 | 1/1988 | Bertrand | 381/36 |
| 4,815,134 | 3/1989 | Picone et al. | 381/36 |
| 4,914,701 | 4/1990 | Zibman | 381/36 |
| 4,918,729 | 4/1990 | Kudoh | 381/36 |
| 4,926,484 | 5/1990 | Nakano | 381/46 |
| 5,091,955 | 2/1992 | Iseda et al. | 381/36 |
| 5,101,433 | 3/1992 | King | 381/36 |
| 5,101,434 | 3/1992 | King | 381/43 |
| 5,115,469 | 5/1992 | Taniguchi et al. | 381/36 |
| 5,129,091 | 7/1992 | Yorimoto et al. | 395/750 |
| 5,136,652 | 8/1992 | Jibbe et al. | 381/31 |

*Primary Examiner*—Fleming Michael R.
*Assistant Examiner*—Tariq R. Hafiz
*Attorney, Agent, or Firm*—Emmanuel J. Lobato; Robert E. Burns

[57] ABSTRACT

A speech coding circuit is disclosed, which comprises a PCM encoder for converting an analog input into a digital output, and a speech coder with voice activity detector which encodes the digital output from the PCM encoder into speech coding data and detects whether the analog input is voice active or non-active, for each period, and then outputs a speech detection flag indicating whether the analog input is voice active or non-active. A power comparator compares the power of the analog input with a predetermined power threshold value and outputs a level detection flag indicating voice activity or non-activity, depending on whether the power of the analog input is greater or smaller than the power threshold value. A mode switch receives the level detection flag indicating voice activity or non-activity and applies to the PCM encoder and the speech coder a mode control signal which puts them into an activated mode or a sleep mode.

1 Claim, 2 Drawing Sheets

SPEECH CODING CIRCUIT

BACKGROUND OF THE INVENTION

The present invention relates to a speech coding circuit for use in a transmitter of digital speech communication such as a digital cordless telephone.

A conventional speech coding circuit, has such a defect that even when an input signal is voice non-active the circuit remains operative and wastes power.

SUMMARY OF THE INVENTION

An object of the present invention is to provide a speech coding circuit which reduces power consumption by putting the PCM encoder and the speech coder into an idle (sleep) mode when the input signal is voice non-active.

The speech coding processing circuit according to the present invention comprises a PCM encoder for converting an analog input into a digital output and a speech coder with a voice activity detector which encodes the digital signal from the PCM encoder into speech coding data and detects whether the analog input is voice active or non-active, for each period, and then outputs a speech detection flag indicating whether the analog input is voice active or non-active. The speech coding circuit of the present invention is characterized by the provision of a power comparator which compares the power of the analog input with a predetermined power threshold value and, depending on whether the former is greater or smaller than the latter, outputs a level detection flag indicating voice activity or non-activity accordingly, and a mode switch which receives the level detection flag indicating voice activity or non-activity and applies to the PCM encoder and the speech coder a mode control signal which puts them into an operation mode or a sleep mode.

BRIEF DESCRIPTION OF THE DRAWINGS

The present invention will be described in detail below in comparison with prior art with reference to accompanying drawings; in which.

DETAILED DESCRIPTION

To make differences between prior art and the present invention clear, an example of prior art will first be described.

Figure 2:
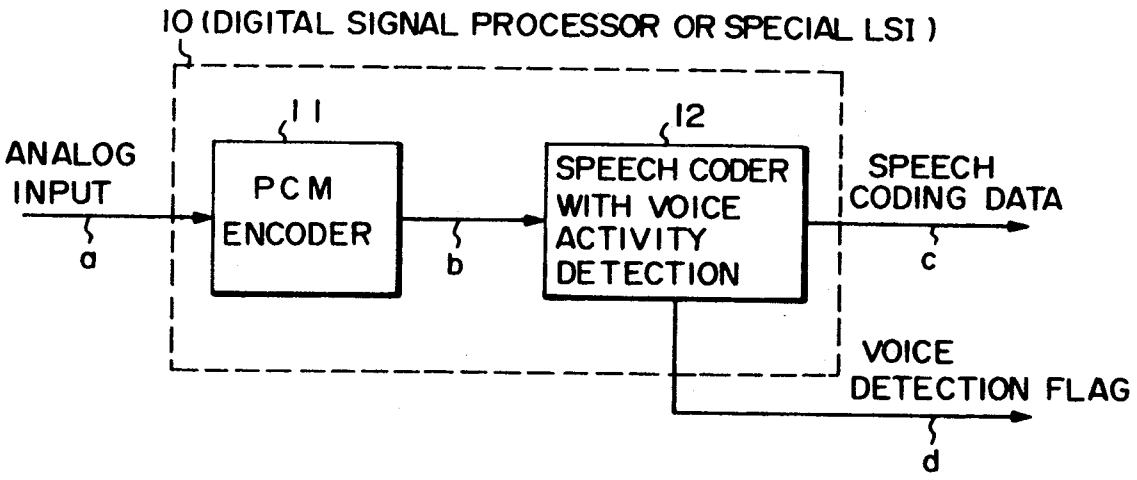
Fig. 2 PRIOR ART
FIG. 2 is a block diagram showing an example of a conventional speech encoding circuit.

In FIG. 2 illustrating a block diagram of a conventional speech coding circuit for use in digital speech communication, an analog input a is converted by a PCM encoder 11 to a digital signal b. The digital signal b is applied to a speech coder with voice activity detector 12, wherein it is subjected to speech coding and speech detection processing, and the speech coder 12 outputs speech coding data c and a speech detection flag d indicating whether the analog input is voice active or non-active.

Reference numeral 10 indicates a digital signal processor (DSP) which includes the PCM encoder 11 and the speech coder with voice activity detector 12 and which is implemented by a combination of universal digital signal processors or special-purpose LSIs. The special-purpose LSI mentioned herein is one that implements the function of the PCM encoder or speech coder with voice activity detection by a full custom chip.

Such a conventional circuit is defective in that even when the analog input a is voice non-active, the PCM encoder 11 and the speech coder 12 (the universal DSPs or special-purpose LSIs) remain operative and hence waste power.

EMBODIMENT

Figure 1:
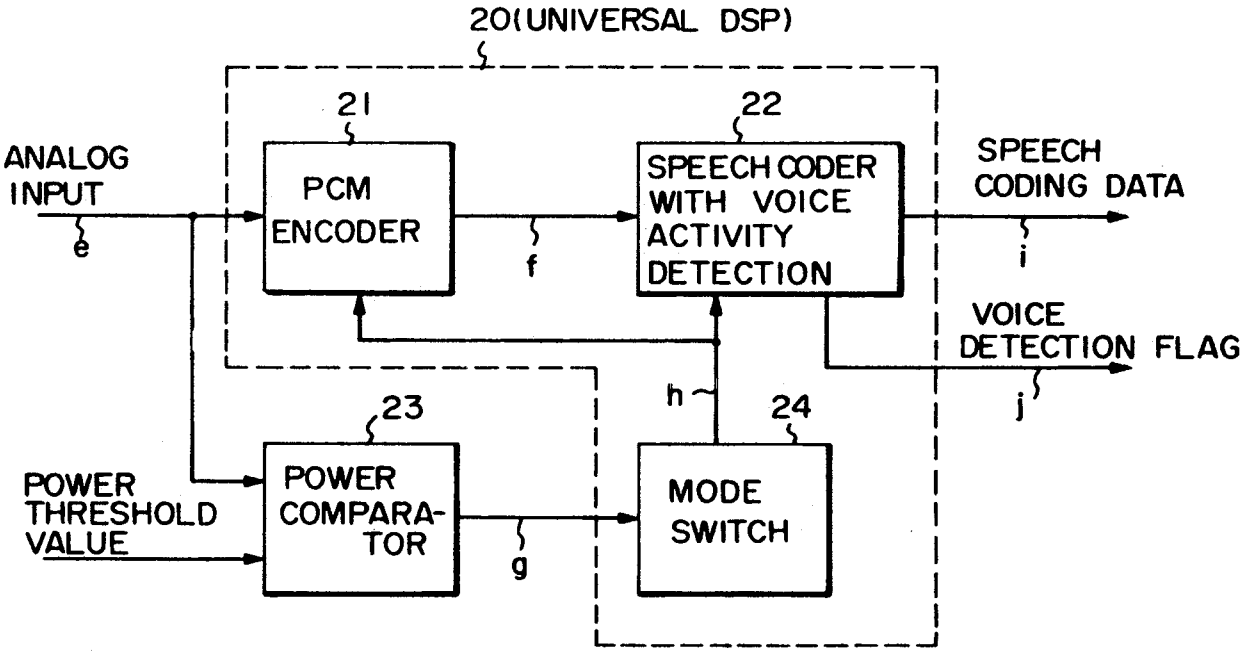
FIG. 1 is a block diagram illustrating an embodiment of the present invention.

FIG. 1 is a block diagram illustrating an embodiment of the present invention. The universal DSP or special-purpose LSI is shown to have built therein an operation mode switching function. An analog input e is converted by a PCM encoder 21 to a digital signal f. At the same time, the analog input (including background noise) e is applied to a power comparator 23, which compares its power level with a power threshold value and outputs a level detection flag g indicating the result of comparison. When the power of the analog input including background noise e is greater than the power threshold value, that is, when the analog input is voice active or background noise is great, the level detection flag g is set to a high level, and when the power of the analog input including background noise is smaller than the power threshold value, that is, when the analog input is voice non-active and background noise is small, the level detection flag g is set to a low level. A mode switch 24 in the universal DSP receives the level detection flag g and outputs a mode control signal h as an activated mode or idle mode signal, depending on whether the level detection flag is high-level or low-level.

The PCM encoder 21 responds to the mode control signal h to perform PCM encoding of the analog input e or not to perform the encoding, depending on whether the mode control signal is the activated mode or idle mode signal.

A speech coder with voice activity detector 22 responds to the mode control signal h to execute speech coding and voice activity detection of the input digital signal f and outputs speech coding data i and a voice de-tection (voice active/non-active) flag j when the mode control signal is the activated mode signal. In case of the idle mode signal, the speech coder 22 does not perform the speech coding and the voice detection. The voice detection (voice active/non-active) flag j in this case is set voice non-active. The voice detection flag j thus set voice non-active is latched while the speech coder 22 remains in the idle mode, and the flag j indicating voice non-activity is output until it is switched to voice activity.

That is, the detection of the voice non-active duration by the power comparator 23 takes place only when the S/N ratio of the input signal e is excellent, and it is detected in the speech coder 22 when the S/N ratio is poor.

Table 1 shows the flag switching operation, i.e. the states of the level detection flag g and the voice detection flag j corresponding to the contents of the analog input e. That is, when the analog input e is voice active or when noise is present (i.e. when background noise is greater than the threshold value), the level detection flag g goes high and the circuit is activated accordingly, and when neither noise nor voice is present, the level detectionflag_g goes low and the circuit stops its operation.

TABLE 1

| Input e | | Level Detection | Voice Detection |
|---|---|---|---|
| Noise | Voice | Flag g | Flag j |
| absent | absent | L | voice non-active |
| present | absent | H | voice non-active |
| absent | present | H | voice active |
| present | present | H | voice active |

Next, a description will be given of how much the power consumption of the speech coder 22 is reduced by the present invention.

It is assumed, here that the voice activity factor in an ordinary conversation is 40%. Furthermore, it was assumed that the ratio of a case where the S/N ratio of the input signal e is excellent (that is, a case where the background noise is very small) is 50% and that the voice active period and the excellent S/N ratio period occur without any correlation there between or independently of each other.

(1) In a case where the speech coder with a voice activity detector is implemented by a universal DSP, comparison of the power consumed in the past, shown in Table 2, and the power consumption of the circuit according to the present invention, shown in Table 3, reveals that the reduction ratio of power consumption is 28%.

TABLE 2

| | Power Consumption | Operation Ratio |
|---|---|---|
| DSP (operation mode) | 60 | 1.0 |

TABLE 3

| | Power Consumption [mW] | Operation Ratio |
|---|---|---|
| DSP (operation mode) | 60 | $0.4 + 0.6 \times 0.5 = 0.7$ |
| DSP (Sleep mode) | 1 | $0.6 \times 0.5 = 0.3$ |
| Power Comparator | 1 | 1.0 |
| Overall Power Consumption | 43.3 [mW] | |

(2) In a case where the speech coder with a voice activity detector is implemented by a special-purpose LSI, the power consumption reduction ration is 27% as shown in Table 4 (a prior art example) and Table 5 (the present invention).

TABLE 4

| | Power Consumption [mW] | Operation Ratio |
|---|---|---|
| Special-Purpose LSI (operation mode) | 40 | 1.0 |

TABLE 4-continued

| | Power Consumption [mW] | Operation Ratio |
|---|---|---|
| (operation mode) | | |

TABLE 5

| | Power Consumption [mW] | Operation Ratio |
|---|---|---|
| Special-Purpose LSI (operation mode) | 40 | $0.4 + 0.6 \times 0.5 = 0.7$ |
| Special-Purpose LSI (sleep mode) | 1 | $0.6 \times 0.5 = 0.3$ |
| Power Comparator | 1 | 1.0 |
| Overall Power Consumption | 29.3 [mW] | |

As described above, according to the present invention, the power consumption of the speech encoding circuit can be reduced more than 20 to 30%. Hence, the present invention is of great utility in practical use.

What we claim is:

1. A speech coding circuit comprising:

a power comparator for comparing power of an analog input with a predetermined input power threshold value to produce a level detection flag, which is indicative of voice active or voice non-active, respectively, in dependence upon whether the power of the analog input or its background noise is greater or smaller than the predetermined power threshold value;

a mode switch receptive of said level detection flag for producing, for each frame period, a mode control signal which assumes an activation state and a sleep state in correspondence to said voice active or said voice non-active, respectively, of said level detection flag;

a PCM encoder controlled into an activated mode or a sleep mode, respectively, in response to the activation state or the sleep state of the mode control signal from the mode switch for converting the analog input into a digital output in case of its activated mode; and a speech coder with voice activity detector controlled into an activated mode or a sleep mode, respectively, in response to the activation state or the sleep state of the mode control signal from the mode switch for encoding, in case of its activated mode, the digital output from the PCM encoder into speech coding data and for detecting, in case of its activated mode, whether the analog input is said voice active or said voice non-active, for each frame period, to produce in case of its activated mode a speech detection flag, which indicates whether the analog input is voice active or voice non-active.

* * * * *